US010410818B2

(12) United States Patent
Yoneda

(10) Patent No.: US 10,410,818 B2
(45) Date of Patent: Sep. 10, 2019

(54) FUSE ELEMENT, FUSE DEVICE, AND PROTECTIVE DEVICE

(71) Applicant: DEXERIALS CORPORATION, Tokyo (JP)

(72) Inventor: Yoshihiro Yoneda, Tochigi (JP)

(73) Assignee: DEXERIALS CORPORATION, Tokyo (JP)

( * ) Notice: Subject to any disclaimer, the term of this patent is extended or adjusted under 35 U.S.C. 154(b) by 0 days.

(21) Appl. No.: 16/321,758

(22) PCT Filed: Aug. 28, 2017

(86) PCT No.: PCT/JP2017/030745

§ 371 (c)(1),
(2) Date: Jan. 29, 2019

(87) PCT Pub. No.: WO2018/051774

PCT Pub. Date: Mar. 22, 2018

(65) Prior Publication Data

US 2019/0172673 A1 Jun. 6, 2019

(30) Foreign Application Priority Data

Sep. 16, 2016 (JP) ..... 2016-182381

(51) Int. Cl.
*H01H 85/11* (2006.01)
*H01H 85/143* (2006.01)
(Continued)

(52) U.S. Cl.
CPC ..... *H01H 85/143* (2013.01); *H01H 37/76* (2013.01); *H01H 69/02* (2013.01); *H01H 85/11* (2013.01); *H01H 85/2045* (2013.01)

(58) Field of Classification Search
CPC ..... H01H 37/76; H01H 69/02; H01H 85/11; H01H 85/143; H01H 85/2045
(Continued)

(56) References Cited

U.S. PATENT DOCUMENTS

2003/0001716 A1* 1/2003 Kaltenborn ..... H01H 85/046 337/273
2010/0176910 A1* 7/2010 Knab ..... H01H 37/761 337/290
(Continued)

FOREIGN PATENT DOCUMENTS

JP 2015-65156 A 4/2015
WO 2015/072122 A1 5/2015
(Continued)

OTHER PUBLICATIONS

Oct. 31, 2017 International Search Report issued in International Patent Application No. PCT/JP2017/030745.

*Primary Examiner* — Jacob R Crum
(74) *Attorney, Agent, or Firm* — Oliff PLC

(57) ABSTRACT

A fuse element as well as a fuse device and protective device using the same which are capable of suppressing generation of defects such as cracks in a high melting point metal layer, maintaining good conduction, and maintaining blowout properties. The fuse element includes a laminated low melting point metal layer and high melting point metal layer and at least one peak among peaks in an X-ray diffraction spectrum (2θ) of a surface of the high melting point metal layer has a full width at half maximum of 0.15 degrees or less.

9 Claims, 14 Drawing Sheets

(51) Int. Cl.
*H01H 37/76* (2006.01)
*H01H 69/02* (2006.01)
*H01H 85/20* (2006.01)

(58) Field of Classification Search
USPC ..... 337/186
See application file for complete search history.

(56) References Cited

U.S. PATENT DOCUMENTS

| | | | | |
|---|---|---|---|---|
| 2012/0087067 | A1* | 4/2012 | Chiu | H01H 85/143 361/679.01 |
| 2015/0318131 | A1 | 11/2015 | Matthiesen et al. | |
| 2016/0013001 | A1* | 1/2016 | Yoneda | H01H 85/11 337/227 |
| 2016/0172143 | A1 | 6/2016 | Yoneda et al. | |
| 2016/0240342 | A1* | 8/2016 | Yoneda | H01H 69/02 |
| 2017/0236673 | A1 | 8/2017 | Yoneda | |

FOREIGN PATENT DOCUMENTS

| | | | |
|---|---|---|---|
| WO | 2016/047681 | A1 | 3/2016 |
| WO | 2016/143353 | A1 | 9/2016 |

* cited by examiner

FIG. 6A
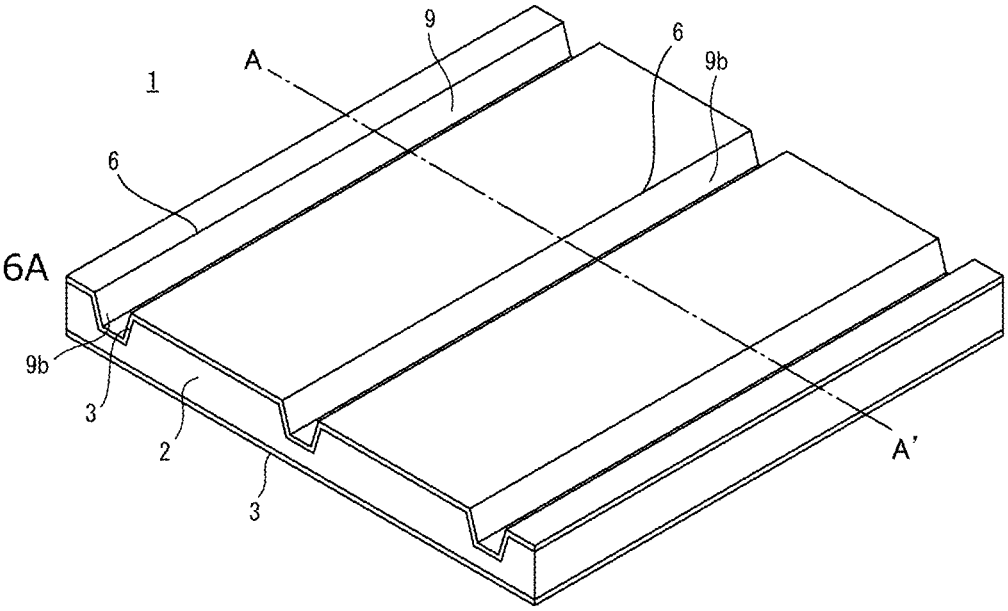
FIG. 6B
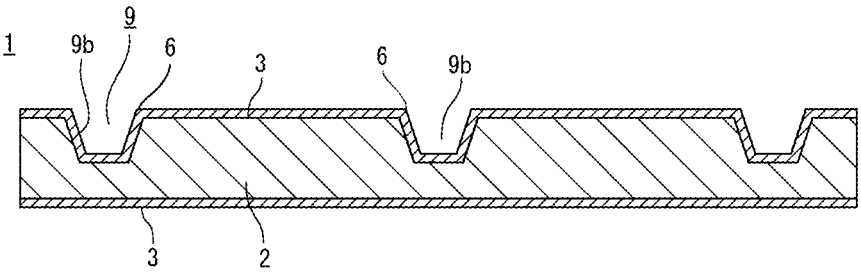
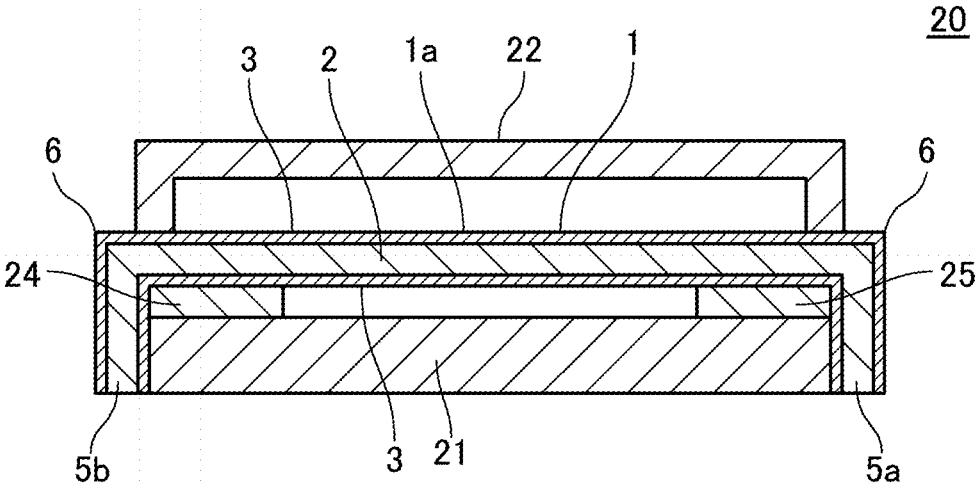
FIG. 7

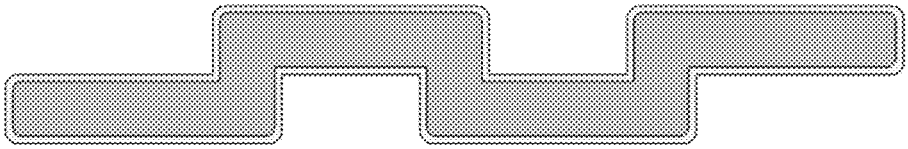
FIG. 14
FIG. 15A
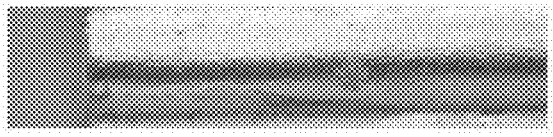
FIG. 15B
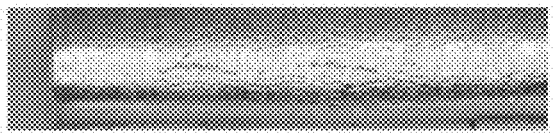
FIG. 15C
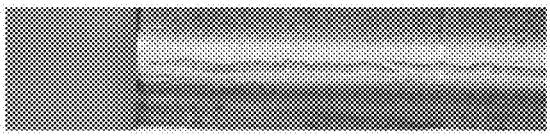

FUSE ELEMENT, FUSE DEVICE, AND PROTECTIVE DEVICE

TECHNICAL FIELD

The present disclosure relates to a fuse element mounted on a current path and blown by self-generated heat when a rate-exceeding current flows, or blown by heat from a heat generator, to interrupt the current path, and relates to a fuse device and protective device using the same. This application claims priority to Japanese Patent Application No. 2016-182381 filed on Sep. 16, 2016, the entire contents of which are hereby incorporated by reference.

BACKGROUND ART

Conventionally, fuse elements blown by self-generated heat when a rate-exceeding current flows are used to interrupt a current path. Examples of commonly used fuse elements include holder-fixed fuses having solder enclosed in glass, chip fuses having an Ag electrode printed on a ceramic substrate surface, and screw-in or insertable fuses having a copper electrode with a narrow portion assembled into a plastic case.

However, problems have been identified in existing fuse elements described above such as inability to surface mount using reflow, low current ratings, and inferior blowout speeds when increasing size for higher current ratings.

Moreover, in the case of a reflow-mountable rapid-interruption fuse device, in general, this would preferably have a high melting point Pb solder with a melting point of 300° C. or more in the fuse element in view of blowout properties. However, use of solder containing Pb is limited with few exceptions under the RoHS directive, and demand for a transition to Pb-free products is expected to rise.

Due to such demand, as illustrated in FIG. 16, a fuse element 100 is used in which a low melting point metal layer 101 such as of Pb-free solder and a high melting point metal layer 102 such as of silver or copper are laminated. Such a fuse element 100 having excellent mounting properties enabling surface mounting in fuse devices and protective devices using reflow is applicable to increased ratings and high-currents due to being covered by a high melting point metal, and can rapidly interrupt a current path by an erosive action of the low melting point metal on the high melting point metal during blowout.

Such a fuse element 100 can be manufactured, for example, by forming a film of high melting point metal 102 such as Ag using film-forming techniques such as plating, vapor deposition, or sputtering on the surface of an elongated low melting point metal layer 101 such as a solder foil.

CITATION LIST

Patent Literature

PLT 1: Japanese Unexamined Patent Application No. 2015-65156

SUMMARY OF INVENTION

Technical Problem

High melting point metal layers formed by thin-film forming methods such as plating, vapor deposition, and sputtering have low crystallinity and low mechanical strength in comparison with bulk materials. Consequently, during deformation such as when bending, cracks form in bent portions; moreover, defects such as boundary and lattice defects increase conductor resistances, lowering performance as a conductive material.

In particular, in the case of laminating a high melting point metal layer such as of Ag at a thickness of 10 μm or more using plating onto the surface of a low melting point metal layer formed of an alloy having Sn as a primary constituent and having a thickness of 100 μm or more, as illustrated in FIG. 17, cracks 103 in the high melting point metal plating are generated in bent portions formed by bending the laminated body in 90° bends. In a fuse element, this might impede increased current ratings or might reduce current ratings, and there is a concern that there might be fluctuations in desired blowout properties of the fuse element, that is, that the fuse element rapidly blows at a predetermined current value and does not blow below the predetermined current value.

Therefore, an object of the present disclosure is to provide a fuse element as well as a fuse device and protective device using the same which are capable of suppressing generation of defects such as cracks in the high melting point metal layer, maintaining good conduction, and maintaining blowout properties.

Solution to Problem

In order to solve the above problems, a fuse element according to the present disclosure has a low melting point metal layer and a high melting point metal layer which are laminated, at least one peak among peaks in an X-ray diffraction spectrum (2θ) of a surface of the high melting point metal layer having a full width at half maximum of 0.15 degrees or less.

Furthermore, a method for manufacturing a fuse element according to the present disclosure includes a laminating step of laminating a high melting point metal layer and a low melting point metal layer and a heating step of heating the high melting point metal layer to a temperature of at least 120° C. and at most a melting point of the low melting point metal layer.

Furthermore, a fuse device according to the present disclosure includes an insulating substrate and the aforementioned fuse element mounted on the insulating substrate.

Furthermore, a protective device according to the present disclosure includes an insulating substrate, the aforementioned fuse element mounted on the insulating substrate, and a heat generator arranged on the insulating substrate for heating and blowing the fuse element.

Advantageous Effects of Invention

According to the present disclosure, because at least one peak among peaks in an X-ray diffraction spectrum (2θ) of a surface of a high melting point metal layer constituting an outer layer has a full width at half maximum of 0.15 degrees or less, crystallinity is improved so that mechanical strength against such processes as bending is improved and resistance is reduced. This can suppress cracks and prevent increased conductor resistance in the fuse element so that the fuse element can have a desired current rating and fluctuation in blowout properties can be prevented.

BRIEF DESCRIPTION OF DRAWINGS

FIG. 6 is (A) an external perspective view and (B) a cross-sectional view along A-A' illustrating a fuse element in which a groove is formed.

FIG. 7 is a cross-sectional view of a fuse device in which a first and second electrode are formed on a surface of an insulating substrate.

FIG. 14 is a cross-sectional view of a fuse element of an example.

FIG. 15 (A) and FIG. 15 (B) are images of fuse elements according to Examples, and FIG. 15 (C) is as an image of a fuse element according to a Comparative Example.

DESCRIPTION OF EMBODIMENTS

Figure 1A:
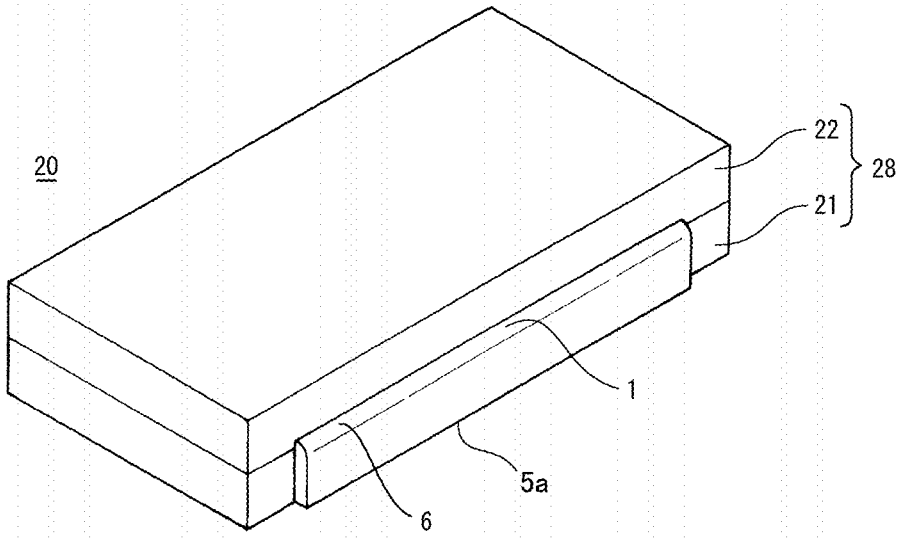
FIG. 1 illustrates a fuse device according to the present disclosure in (A) an external perspective view of the fuse device, and (B) a cross-sectional view of the fuse device.

Hereinafter, a fuse element, a fuse device, and a protective device according to the present disclosure will be described in detail with reference to the accompanying drawings. It should be noted that the present disclosure is not limited to the following embodiments and various modifications can be made without departing from the scope of the present disclosure. Moreover, the features illustrated in the drawings are shown schematically and are not intended to be drawn to scale. Actual dimensions should be determined in consideration of the following description. Furthermore, those skilled in the art will appreciate that dimensional relations and proportions may be different among the drawings in certain parts.

Fuse Element

First, a fuse element according to the present disclosure will be described. A fuse element 1 according to the present disclosure is used as a fusible conductor in a fuse device and a protective device to be described below and is blown by self-heating (Joule heating) caused when a rate-exceeding current flows or blown by heat from a heat generator. In the following, while configuration of the fuse element 1 is described in a case of being mounted in a fuse device 20, it should be noted that operation is equivalent in the case of being mounted in a protective device described below.

Figure 1B:
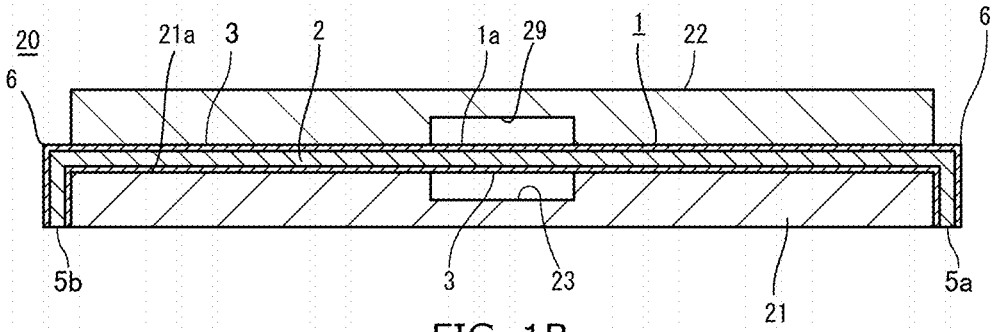
Figure 2A:
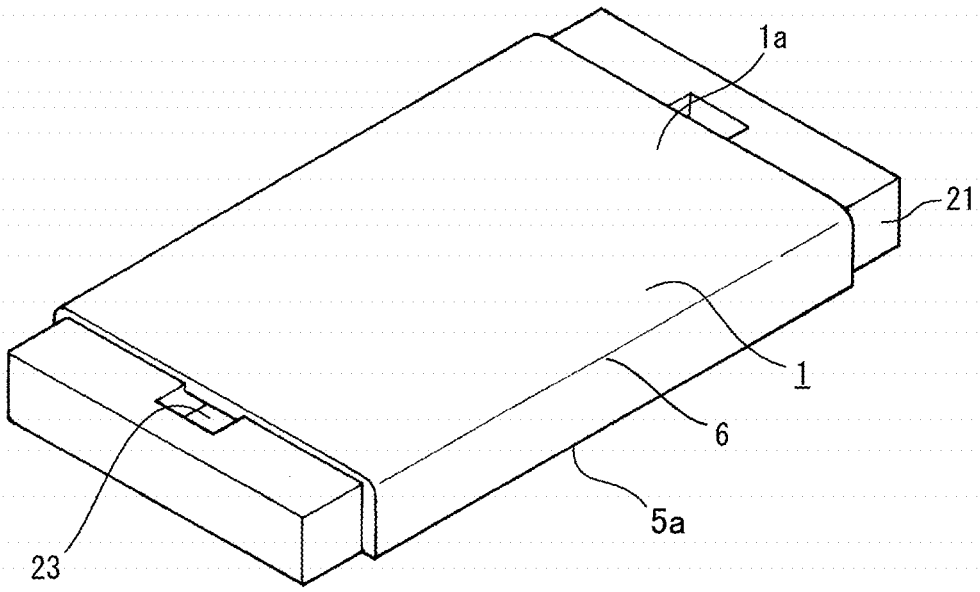
FIG. 2 is (A) an external perspective view illustrating a state in which a fuse element is mounted to a surface of an insulating substrate and (B) an external perspective view illustrating the insulating substrate.
Figure 2B:
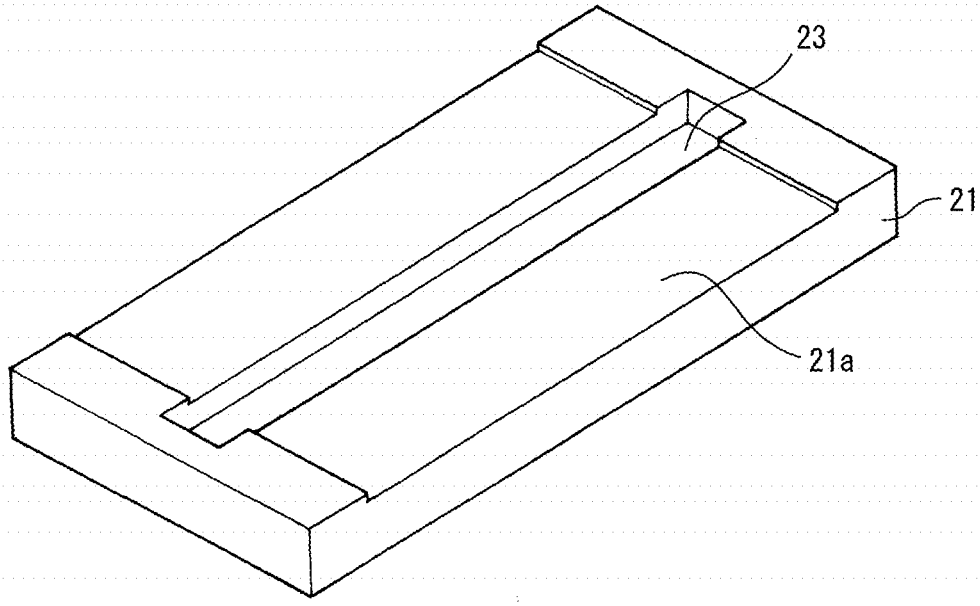

The fuse element 1, for example, is formed in a roughly rectangular plate-shape having a total thickness of approximately 200 μm and is mounted on an insulating substrate 21 of the fuse device 20 as illustrated in FIGS. 1 (A) and (B) as well as FIGS. 2 (A) and (B). The fuse element 1 has a low melting point metal layer 2 constituting an inner layer and a high melting point metal layer 3 constituting an outer layer having a melting point higher than that of the low melting point metal layer 2.

The high melting point metal layer 3, for example, is preferably formed of Ag, Cu, or an alloy having Ag or Cu as a primary constituent and has a high melting point so as not to melt even in the case of mounting the fuse element 1 on the insulating substrate 21 using a reflow oven.

The low melting point metal layer 2 is preferably formed of, for example, Sn or an alloy containing Sn as a primary constituent, a material commonly known as "Pb-free solder." The melting point of the low melting point metal layer 2 is not necessarily higher than reflow oven temperature and may be less than 260° C. Moreover, the low melting point metal layer 2 may use Bi, In, or an alloy containing Bi or In having an even lower melting point.

Manufacturing Method of Fuse Element 1

The fuse element 1 can be manufactured by film-forming a high melting point metal using plating techniques on the low melting point metal layer 2. For example, an element film can be manufactured by plating Ag, such as by electroplating, on a long solder foil which can be cut to size according to need to efficiently manufacture the fuse element 1 and allow convenient use.

Terminal Portion

Furthermore, both end portions in the long direction of the fuse element 1 are preferably bent to form a pair of terminal portions 5*a*, 5*b* for connecting to an external circuit. Forming the terminal portions 5*a*, 5*b* in the fuse element 1 and providing electrodes on the surface for mounting the fuse element 1 of the insulating substrate 21 removes the need to provide external connection electrodes on a back surface of the insulating substrate 21 for connecting to these electrodes, thus simplifying manufacturing processes as well as eliminating restrictions on current ratings due to electrical resistance between electrodes of the insulating substrate 21 and external connection electrodes and allowing the fuse element 1 itself to regulate the rated current so that current ratings can be improved.

The terminal portions 5*a*, 5*b* are formed by bending edge portions of the fuse element 1 mounted on a surface of the insulating substrate 21 to follow a side surface of the insulating substrate 21 and may also be bent outward or inward one or more times as appropriate. Thus, a bent portion 6 is formed in the fuse element 1 between a substantially flat main surface and a surface of a bent end.

Then, in the fuse device 20, the terminal portions 5*a*, 5*b* are exposed to the exterior of the device so that, when mounted to an external circuit substrate, the terminal portions 5*a*, 5*b* are connected to terminals formed on the external circuit substrate such as by using solder, thus incorporating the fuse element 1 into the external circuit.

Concave/Convex, Open Hole, and Embossing

Figure 3:
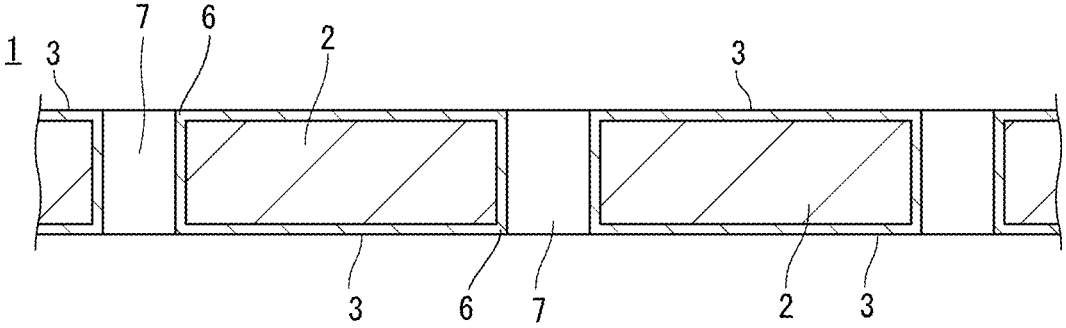
FIG. 3 is a cross-sectional view illustrating a fuse element in which an open hole is formed.
Figure 4:
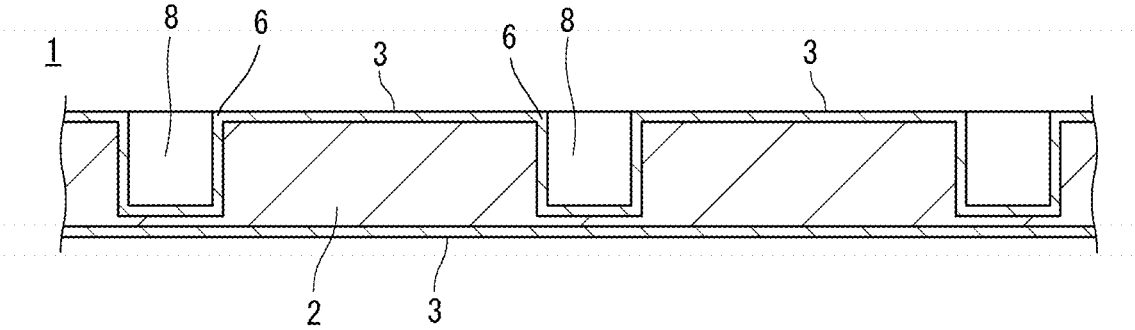
FIG. 4 is a cross-section view illustrating a fuse element in which a blind hole is formed.
Figure 5A:
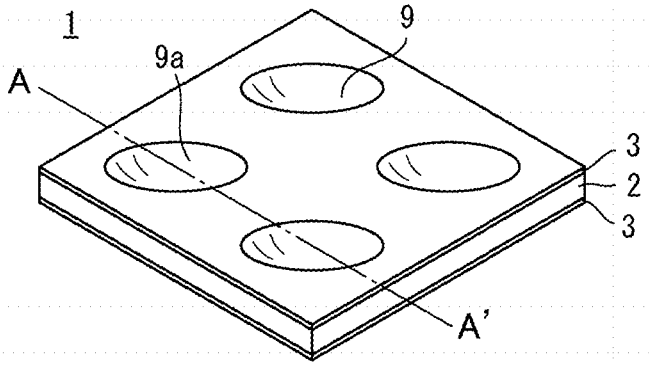
FIG. 5 is (A) an external perspective view and (B) a cross-sectional view along A-A' illustrating a fuse element in which an embossed portion is formed.
Figure 5B:
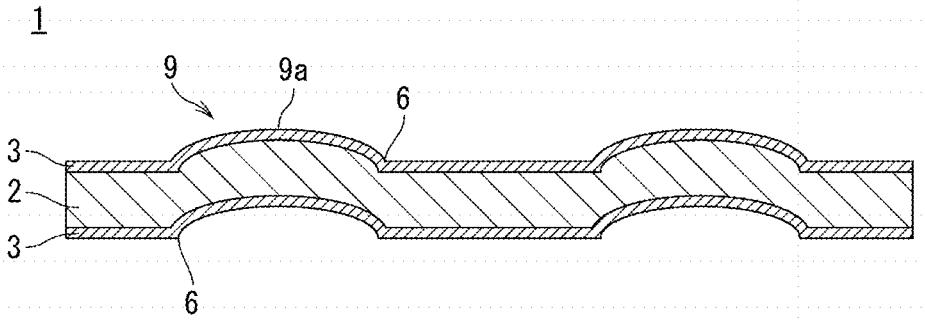

Furthermore, in the fuse element 1, under high-temperature conditions such as during reflow, to prevent variance in resistance as well as fluctuations in blowout properties due to the low melting point metal flowing and local collapsing/expanding, an open hole 7 (FIG. 3) or a blind hole 8 (FIG. 4) may be formed, or a concave/convex portion 9 such as an embossed portion 9*a* (FIG. 5) or a groove 9*b* (FIG. 6) may be formed on a front surface and/or a back surface. Such an open hole 7, blind hole 8, and concave/convex portion 9 can be formed, for example, by processing, such as by punching or pressing, a sheet-form laminated body of a low melting point metal layer and high melting point metal layer or by processing, such as by punching or pressing, a low melting point metal foil before covering with a high melting point metal. Then, by forming such an open hole 7, blind hole 8, or concave/convex portion 9, the bent portion 6 is formed in the fuse element 1 between a substantially flat main surface and an inner circumferential surface or concave/convex surface of the open hole 7, the blind hole 8, the embossed portion 9, or the groove 9*b*.

Crystallinity

Herein, in the fuse element 1, crystallinity of the high melting point metal layer constituting an outer layer is increased to improve mechanical strength against such processes as bending and to reduce electrical resistance. This suppresses cracks in the bent portion 6 and prevents increased conductor resistance to provide the fuse element 1 with a desired current rating and prevent fluctuations in blowout properties.

Crystallinity can be verified by full widths at half maximum of the 2θ peaks in the X-ray diffraction spectrum, and the full width at half maximum of at least one of a plurality of reflection peaks is preferably 0.15 degrees or less. Furthermore, the greatest peak preferably has a full width at half maximum of 0.15 degrees or less.

In order to improve crystallinity in the fuse element 1, after laminating the low melting point metal layer and the high melting point metal layer, the fuse element 1 is heat-treated at a temperature of 120° C. or higher. By heat-treating, a stable crystal structure is formed in the high melting point metal layer and crystallinity is improved. Treating with heat before forming the terminal portions 5*a*, 5*b*, the open hole 7, the blind hole 8, or the concave/convex portion 9 in the fuse element 1 can suppress cracks in the bent portion 6.

Furthermore, the fuse element 1 is preferably heat-treated at a temperature not exceeding the melting point of the low melting point metal, and as described above, in the case of using Sn or an alloy containing Sn as a primary constituent in the low melting point metal and using Ag, Cu, or an alloy containing Ag or Cu as a primary constituent in the high melting point metal, the fuse element 1 is preferably heat-treated at 210° C. or less. Heat-treating at 210° C. or less can suppress excessive flow of the low melting point metal and prevent erosion of the high melting point metal by melted low melting point metal, which can prevent fluctuations in blowout properties caused by fluctuations in resistance.

It should be noted that the volume of the low melting point metal layer 2 is preferably greater than the volume of the high melting point metal layer 3 in the fuse element 1. A greater volume of the low melting point metal layer 2 of the fuse element 1 reduces blowout times due to effective erosion of the high melting point metal layer 3.

Fuse Device

Next, a fuse device using the above-described fuse element 1 will be explained. A fuse device 20 according to the present disclosure, as illustrated in FIG. 1, includes an insulating substrate 21, a fuse element 1 mounted on a surface 21*a* of the insulating substrate 21, and a cover member 22 covering above the surface 21*a* of the insulating substrate 21 on which the fuse element 1 is mounted and constituting, together with the insulating substrate 21, a device housing 28.

The fuse element 1 has a pair of terminal portions 5*a*, 5*b* which are led to the exterior of the device housing 28 formed by joining the insulating substrate 21 and the cover member 22, and the fuse element 1 can be connected with connecting electrodes of an external circuit via the terminal portions 5*a*, 5*b*.

The insulating substrate 21, for example, is a rectangular member that is electrically insulating and made of an engineering plastic such as liquid-crystal polymer, alumina, glass ceramics, mullite, or zirconia. In addition, as the insulating substrate 21, materials used in printed circuit boards such as glass epoxy substrates or phenol substrates, among others, may be used.

The cover member 22, as in the insulating substrate 21, can be an electrically insulating member made of any of a variety of engineering plastics, ceramics, or other material and is connected to the insulating substrate 21 via, for example, an electrically insulating adhesive agent. In the fuse device 20, by covering the fuse element 1 with the cover member 22, even in the case of arc-discharge accompanying self-heating and interruption due to an overcurrent, melted metal is trapped by the cover member 22 which prevents scattering to the surroundings.

A groove 23 is formed on a surface 21*a* for mounting the fuse element 1 on the insulating substrate 21. Furthermore, a groove 29 facing the groove 23 is formed in the cover member 22. The grooves 23, 29 are spaces at which the fuse element 1 blows and is interrupted; a portion of the fuse element 1 corresponding to locations of the grooves 23, 29 contacts air which is a poor thermal conductor and serves as a blowout portion 1*a* which is more prone to temperature increase and blowout than other portions of the fuse element 1 in contact with the insulating substrate 21 and cover member 22.

It should be noted that an electrically conductive adhesive or solder may be interposed between the insulating substrate 21 and the fuse element 1 as appropriate. In the fuse device 20, by connecting the insulating substrate 21 and fuse element 1 via an adhesive or solder, close contact is improved so that heat can be more efficiently transmitted to the insulating substrate 21 and relatively heat and blow the blowout portion 1*a*.

Moreover, as illustrated in FIG. 7, instead of providing the groove 23 in the insulating substrate 21 of the fuse device 20, a first electrode 24 and a second electrode 25 may be provided on the surface 21*a* of the insulating substrate 21. The first and second electrodes 24, 25 are each conductive patterns which can be made of Ag or Cu and may be provided with a protective layer by forming an Sn plating, a Ni/Au plating, an Ni/Pd plating, or an Ni/Pd/Au plating on surfaces as a measure for preventing oxidation as appropriate.

The first and second electrodes 24, 25 may be connected with the fuse element 1 via a connection-use solder. Connecting the fuse element 1 to the first and second electrodes 24 and 25 increases heat transmission in portions excluding the blowout portion 1*a* so that heating and blowout of the blowout portion 1*a* is more effective.

It should be noted that, in the configuration illustrated in FIG. 7, the insulating substrate 21 of the fuse device 20 may be provided with the groove 23.

Figure 8:
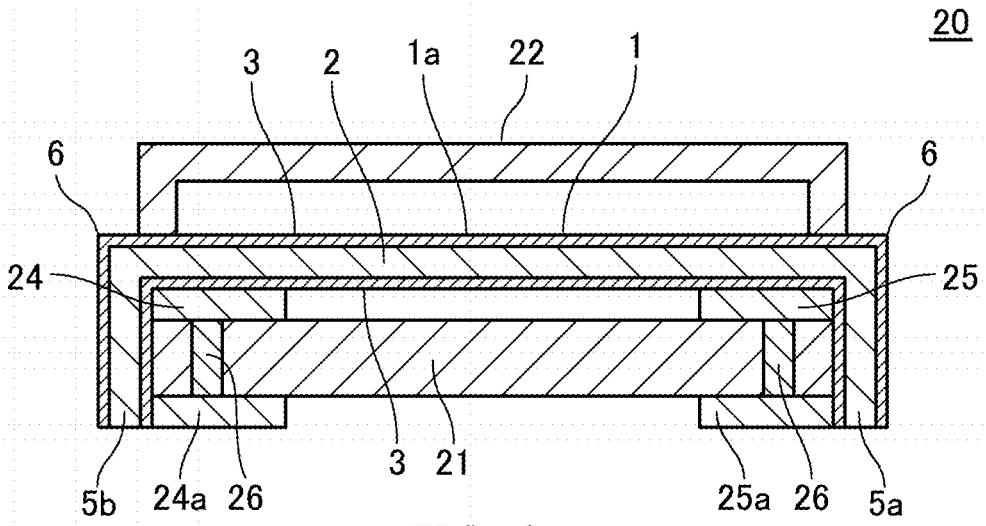
FIG. 8 is a cross-sectional view of a fuse device in which a first and a second external connection electrode are formed on a back surface of an insulating substrate.

Moreover, in the fuse device 20, instead of providing the fuse element 1 with the terminal portions 5*a*, 5*b*, or, as illustrated in FIG. 8, in addition to the terminal portions 5*a*, 5*b*, a first and second external connection electrodes 24*a*, 25*a* electrically connected to the first and second electrodes 24, 25 may be provided on a back surface 21*b* of the insulating substrate 21. The first and second electrodes 24, 25 and the first and second external connection electrodes 24*a*, 25*a* are conductively connected via through-holes 26 or castellations penetrating the insulating substrate 21. The first and second external connection electrodes 24*a*, 25*a* may also each be a conductive pattern such as of Ag or Cu and may be provided with a protective layer made of, for example, an Sn plating, an Ni/Au plating, an Ni/Pd plating, or an Ni/Pd/Au plating on a surface as a measure to prevent oxidation as appropriate. The fuse device 20 can be mounted on a current path of an external circuit substrate via the first and second external connection electrodes 24*a*, 25*a* instead of the terminal portions 5*a*, 5*b*, or in addition to the terminal portions 5*a*, 5*b*.

It should be noted that in the fuse device 20 illustrated in FIGS. 7 and 8, the fuse element 1 may be mounted in separation from the surface 21*a* of the insulating substrate 21. Therefore, in the fuse device 20, even when the fuse element 1 melts, the melted metal does not erode into the insulating substrate 21 and is drawn onto the first and second electrodes 24, 25 to reliably provide electrical insulation between the first and second electrodes 24, 25.

Furthermore, in the fuse device 20, to prevent oxidation of the high melting point metal layer 3 or the low melting point metal layer 2 as well as to remove oxides during blowout and improve flow of the solder, a top surface and/or bottom surface of the fuse element 1 may be coated with a flux not illustrated in the drawings.

By coating with the flux, even in the case of forming an antioxidation layer such as a Pb-free solder having Sn as a primary constituent on a surface of an outer layer of the high melting point metal layer 3, it is possible to remove oxides of the antioxidation layer and effectively prevent oxidation of the high melting point metal layer 3 to maintain and improve blowout properties.

Circuit Configuration

Figure 9A:
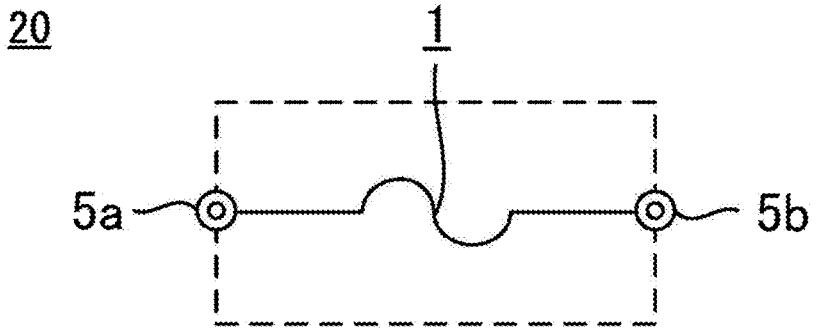
FIG. 9 is a circuit diagram of a fuse device (A) before blowout and (B) after blowout of a fuse element.
Figure 9B:
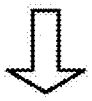
Figure 9B:
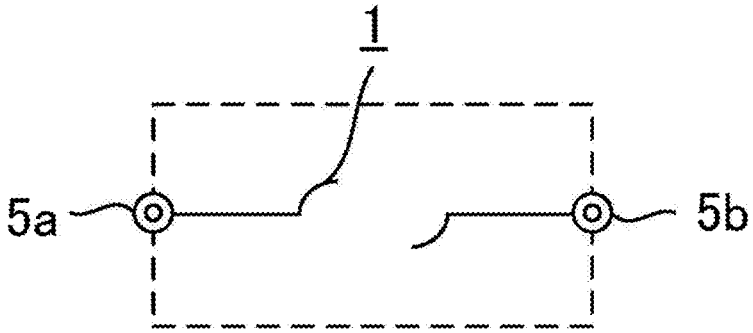
Figure 10A:
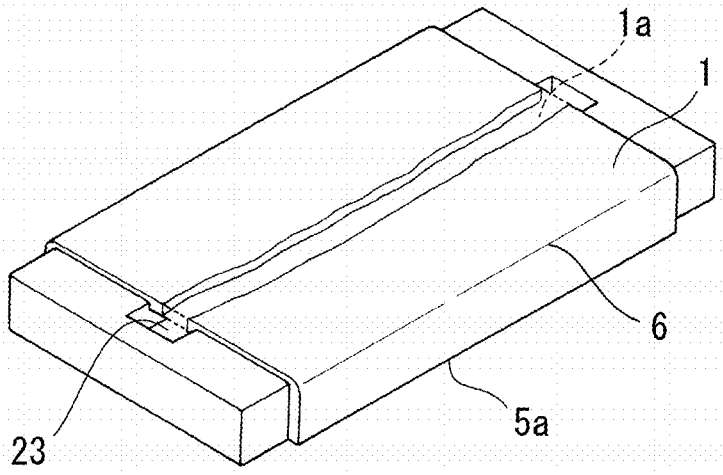
FIG. 10 illustrates a fuse device after blowout of a fuse element in (A) a perspective view omitting a cover member and (B) a cross-sectional view.
Figure 10B:
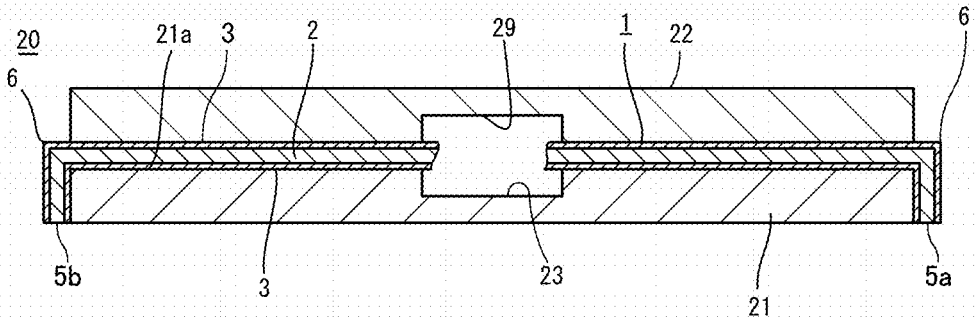

Such a fuse device 20 has a circuit configuration as illustrated in FIG. 9 (A). The fuse device 20 can be incorporated into a current path of an external circuit by mounting the fuse device 20 on the external circuit via the terminal portions 5*a*, 5*b* (and/or the first and second external connection electrodes 24*a*, 25*a*). The fuse device 20 is not blown by self-heating while a predetermined rated current flows through the fuse element 1. Then, in the fuse device 20, when an overcurrent exceeding the current rating flows, as illustrated in FIGS. 10 (A) and (B), the fuse element 1 is blown by self-generated heat, which creates an interruption between the terminal portions 5*a*, 5*b* (and/or first and second external connection electrodes 24*a*, 25*a*) and thus interrupts the current path of the external circuit (FIG. 9 (B)).

During this, due to the low melting point metal layer 2 having a melting point lower than that of the high melting point metal layer 3 being laminated in the fuse element 1 as described above, melting starts from the melting point of the low melting point metal layer 2 due to self-generated heat caused by the overcurrent, and erosion of the high melting point metal layer 3 begins. Thus, erosive action of the low melting point metal layer 2 on the high melting point metal layer 3 can be used to melt the high melting point metal layer 3 at a temperature lower than its melting point so that the fuse element 1 can be rapidly blown.

Protective Device

Figure 11A:
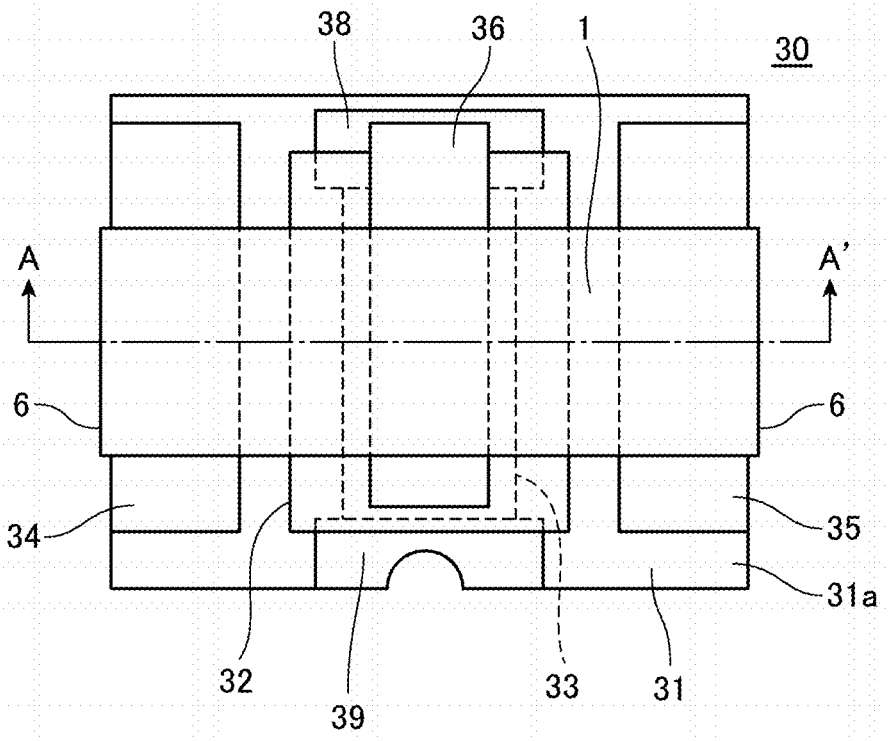
FIG. 11 illustrates a fuse element and protective device according to the present disclosure in (A) a plan view of the protective device omitting a cover member and (B) a cross-sectional view of the protective device.
Figure 11B:
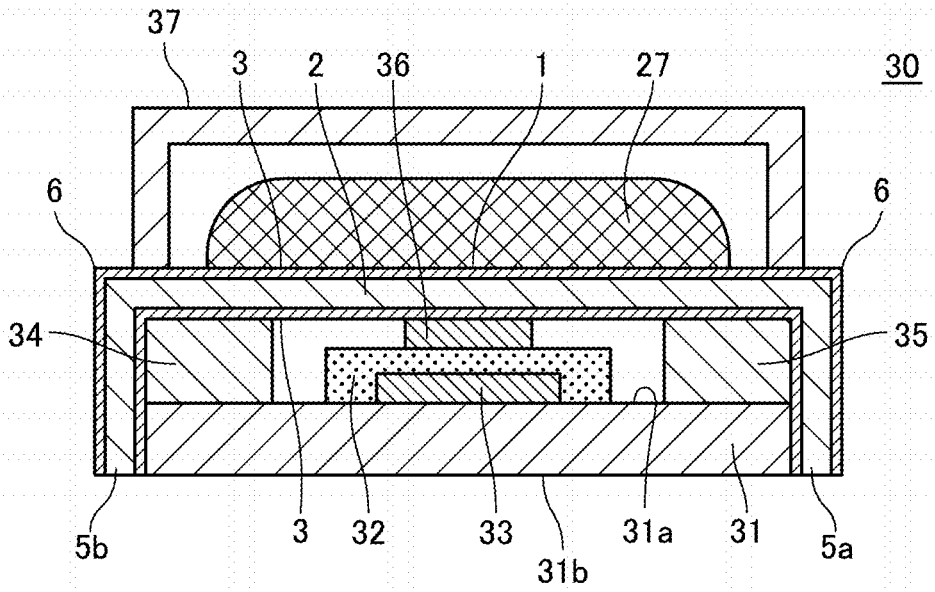

Hereinafter, a protective device using the fuse element 1 will be described. In the following description, the same members as those of the above-described fuse device 20 are denoted by the same reference numerals, and redundant explanation will be omitted. As illustrated in FIGS. 11 (A) and (B), a protective device 30 according to the present disclosure includes an insulating substrate 31, a heat generator 33 laminated on the insulating substrate 31 covered by an electrically insulating member 32, a first electrode 34 and a second electrode 35 formed on both ends of the insulating substrate 31, a heat generator lead electrode 36 electrically connected to the heat generator 33 and laminated above the insulating substrate 31 so as to overlap the heat generator 33, and a fuse element 1 connected on both ends to the first and second electrodes 34, 35, respectively, and connected to the heat generator lead electrode 36 in a central portion of the fuse element 1. Furthermore, the protective device 30 is provided with a cover member 37 attached to protect interior portions above the insulating substrate 31.

The insulating substrate 31, as in the insulating substrate 21 described above, is a rectangular member that is electrically insulating and made of an engineering plastic such as liquid-crystal polymer, alumina, glass ceramics, mullite, or zirconia. In addition, as the insulating substrate 31, a material used for a printed wiring board such as glass epoxy substrates or phenol substrates, among others, may be used.

On a surface 31*a* of the insulating substrate 31, the first and the second electrodes 34, 35 are formed on mutually opposite ends. Wettability of the first and the second electrodes 34, 35 causes the melted fuse element 1 to gather when energizing the heat generator 33 to generate heat so that blowout occurs between the terminal portions 5*a*, 5*b*.

The heat generator 33 generates heat when energized and is made of an electrically conductive material such as nichrome, W, Mo, Ru, or a material containing these. The heat generator 33 can be formed by mixing a powdered alloy or composition/compound of these materials with a resin binder to make a paste used to form a pattern on the insulating substrate 31, for example, by using screen printing techniques and baking.

Moreover, in the protective device 30, the heat generator 33 is covered by the electrically insulating member 32, and a heat generator lead electrode 36 is formed to face the heat generator 33 via the electrically insulating member 32. The fuse element 1 is connected to the heat generator lead electrode 36, thereby, the heat generator 33 is overlapped by the fuse element 1 via the electrically insulating member 32 and the heat generator lead electrode 36. The electrically insulating member 32 is provided not only to electrically insulate and protect the heat generator 33 but also to efficiently convey heat from the heat generator 33 to the fuse element 1 and may be a glass layer.

Furthermore, the heat generator 33 may be formed in an inner portion of the electrically insulating member 32 laminated on the insulating substrate 31. Moreover, the heat generator 33 may be formed on a back surface 31*b* of the insulating substrate 31 opposite the surface 31*a* on which the first and second electrodes 34, 35 are formed, or may be formed adjacent to the first and second electrodes 34, 35 on a surface 31*a* of the insulating substrate 31. Furthermore, the heat generator 33 may be formed in the interior of the insulating substrate 31.

The heat generator 33 is connected on one end to the heat generator lead electrode 36 via a first heat generator electrode 38 formed on the surface 31*a* of the insulating substrate 31 and connected on the other end to a second heat generator electrode 39 formed on the surface 31*a* of the insulating substrate 31. The heat generator lead electrode 36 is connected to the first heat generator electrode 38 laminated above the electrically insulating member 32 facing the heat generator 33 and connected to the fuse element 1. Thus, the heat generator 33 is electrically connected to the fuse element 1 via the heat generator lead electrode 36. It should be noted that positioning the heat generator lead electrode 36 to face the heat generator 33 via the electrically insulating member 32 not only allows the fuse element 1 to be melted but can also promote gathering of melted conductor.

Figure 12B:
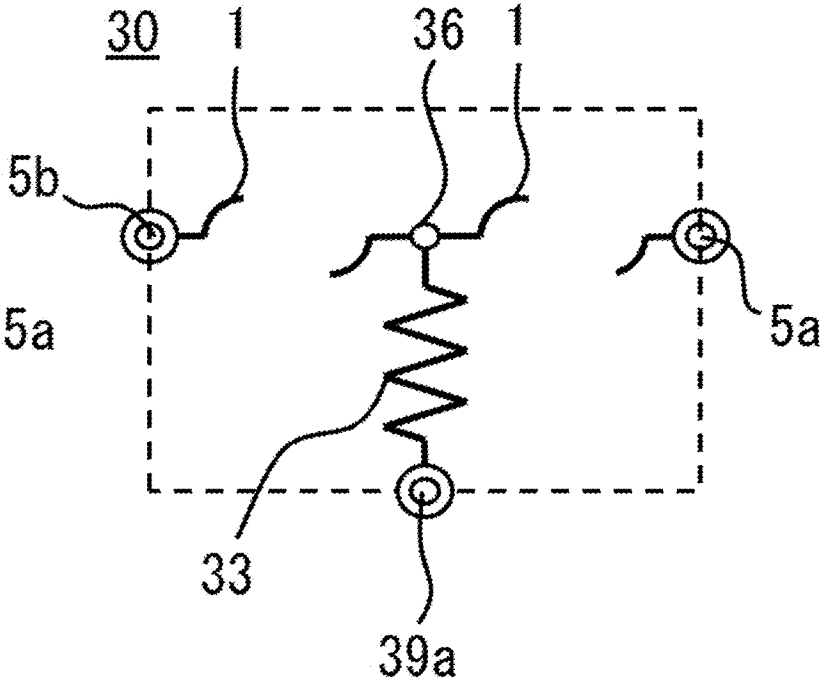
FIG. 12 is a circuit diagram illustrating a protective device (A) before blowout and (B) after blowout of a fuse element.
Figure 12A:
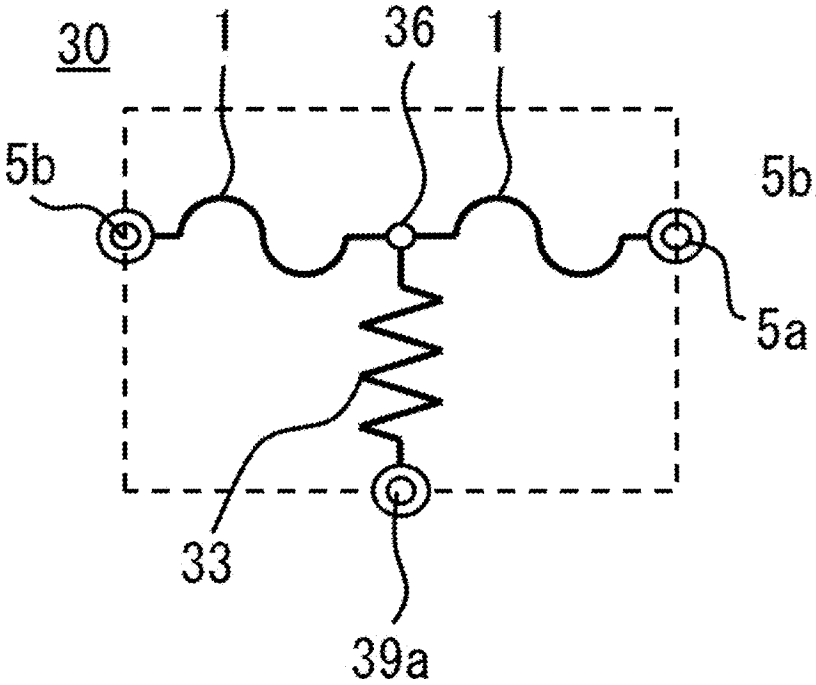

Furthermore, the second heat generator electrode 39 is formed on the surface 31*a* of the insulating substrate 31 and is continuous with heat generator supply electrode 39*a* formed on the back surface of the insulating substrate 31 via a castellation (refer to FIG. 12 (A)).

In the protective device 30, the fuse element 1 is connected to the first electrode 34 and the second electrode 35 as well as the heat generator lead electrode 36 between the first and second electrodes 34, 36. The fuse element 1 is connected to the first and second electrodes 34, 35 and onto the heat generator lead electrode 36 via a connective material such as connection-use solder.

Flux

Furthermore, in the protective device 30, to prevent oxidation of the high melting point metal layer 3 or the low melting point metal layer 2 as well as to remove oxides during blowout and improve flow of solder, a top surface and/or bottom surface of the fuse element 1 may be coated with a flux 27. Coating with the flux 27 not only improves wettability of the low melting point metal layer 2 (for example solder) but also removes oxides generated while the low melting point metal is melted and improves blowout properties by making use of erosive action on the high melting point metal (for example Ag) during operation of the protective device 30.

Furthermore, by coating with the flux 27, even in the case of forming an antioxidation layer of, for example, Pb-free solder having Sn as a primary constituent on a surface of an outer layer of the high melting point metal layer 3, oxides of the antioxidation layer can be removed and oxidation of the high melting point metal layer 3 can be effectively prevented and blowout properties can be maintained and improved.

It should be noted that the first and second electrodes 34, 35, the heat generator lead electrode 36, and the first and second heat generator electrodes 38, 39 are formed by a conductive pattern such as of Ag or Cu, and a protective layer of Sn plating, Ni/Au plating, Ni/Pd plating, Ni/Pd/Au plating, or other plating is preferably formed as appropriate on their surfaces. This prevents oxidation of these surfaces and suppresses erosion of the first and second electrodes 34, 35 as well as the heat generator lead electrode 36 caused by connective material such as solder used to connect the fuse element 1.

Cover Member

Furthermore, the protective device 30 is provided with a cover member 37 for protecting the interior and for preventing scattering of melted material from the fuse element 1 attached above the surface 31*a* of the substrate 31 provided with the fuse element 1. The cover member 37 can be an electrically insulating member made of any of a variety of engineering plastics, ceramics, or other material. Because the fuse element 1 is covered by the cover member 37 in the protective device 30, melted metal is trapped by the cover member 37 and prevented from scattering to the surroundings.

In such a protective device 30, a conductive path to the heat generator 33 is formed which includes the heat generator supply electrode 39*a*, the second heat generator electrode 39, the heat generator 33, the first heat generator electrode 38, the heat generator lead electrode 36, and the fuse element 1. Furthermore, in the protective device 30, the second heat generator electrode 39 is connected to an external circuit energizing the heat generator 33 via the heat generator supply electrode 39*a*, and the external circuit controls current passing through the second heat generator electrode 39 and fuse element 1.

In the protective device 30, by connecting the fuse element 1 and the heat generator lead electrode 36, the fuse element 1 constitutes part of the conductive path to the heat generator 33. Accordingly, in the protective device 30, when the fuse element 1 melts and interrupts the connection with the external circuit, because this also interrupts the conductive path to the heat generator 33, heating can be stopped.

Circuit Diagram

A protective device 30 according to the present disclosure has a circuit configuration such as illustrated in FIG. 12. Thus, the protective device 30 has a circuit configuration in which the fuse element 1 is connected in series between the terminal portions 5*a*, 5*b* via the heat generator lead electrode 36 and the heat generator 33 is connected to the fuse element 1 via a connection point through which current passes to generate heat and melt the fuse element 1. Furthermore, in the protective device 30, the terminal portions 5*a*, 5*b* provided on both ends of the fuse element 1 and the heat generator supply electrode 39*a* connected with the second heat generator electrode 39 are connected to an external circuit of the substrate. Thereby, in the protective device 30, the fuse element 1 is connected in series on a current path of the external circuit via the terminal portions 5*a*, 5*b* and the heat generator 33 is connected via the heat generator electrode 39 with a current control element provided in the external circuit.

Blowout Process

When the protective device 30 with such a circuit configuration needs to interrupt the current path of the external circuit, the current control element provided in the external circuit energizes the heat generator 33. Thereby, in the protective device 30, heat generated by the heat generator 33 melts the fuse element 1 installed in the current path of the external circuit and the highly wettable heat generator lead electrode 36 and first and second electrodes 34, 35 attract melted conductor of the fuse element 1 to blow out the fuse element 1. Thus, the fuse element 1 can be reliably blown between the terminal portion 5*a* and the heat generator lead electrode 36 and between the heat generator lead electrode 36 and the terminal portion 5*b* (FIG. 12 (B)) so that the current path of the external path can be reliably interrupted. Moreover, blowing the fuse element 1 interrupts the power supply to the heat generator 33.

During this, heating of the heat generator 33 starts to melt the fuse element 1 from the melting point of the low melting point metal layer 2 having a melting point lower than that of the high melting point metal layer 3 and the low melting point metal layer 2 begins to erode the high melting point metal layer 3. Thus, in the fuse element 1, the erosive action on the low melting point metal layer 2 on the high melting point metal layer 3 can be used to melt the high melting point metal layer 3 at a temperature lower than its melting point so that the current path of the external circuit can be rapidly interrupted.

Figure 13A:
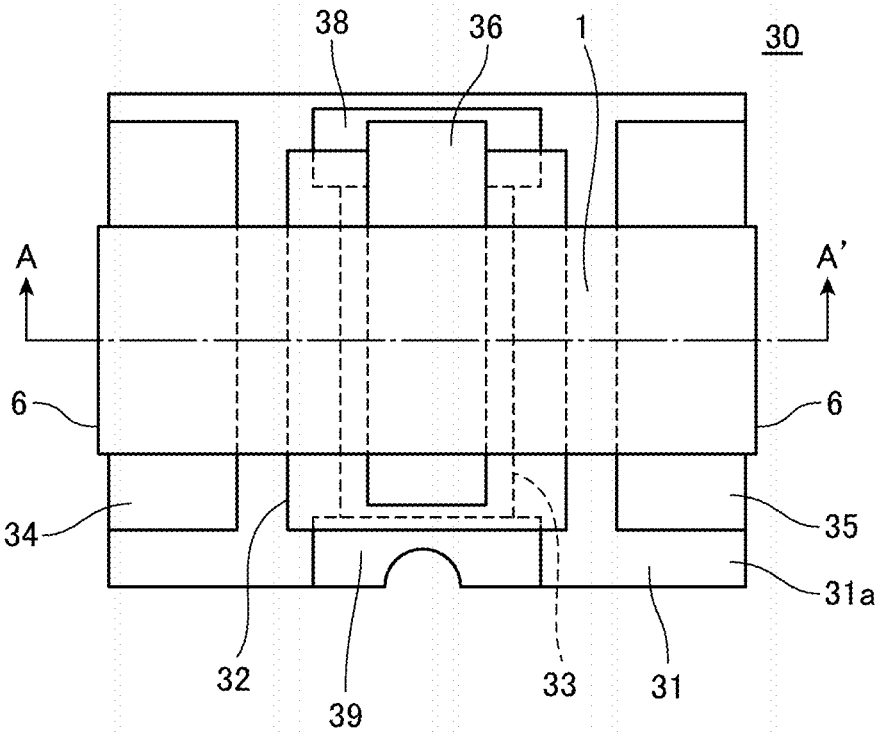
FIG. 13 illustrates a protective device in which a first and second external connection electrode are formed on a back surface of an insulating substrate in (A) a plan view of the protective device with a cover member removed and (B) a cross-sectional view of the protective device.
Figure 13B:
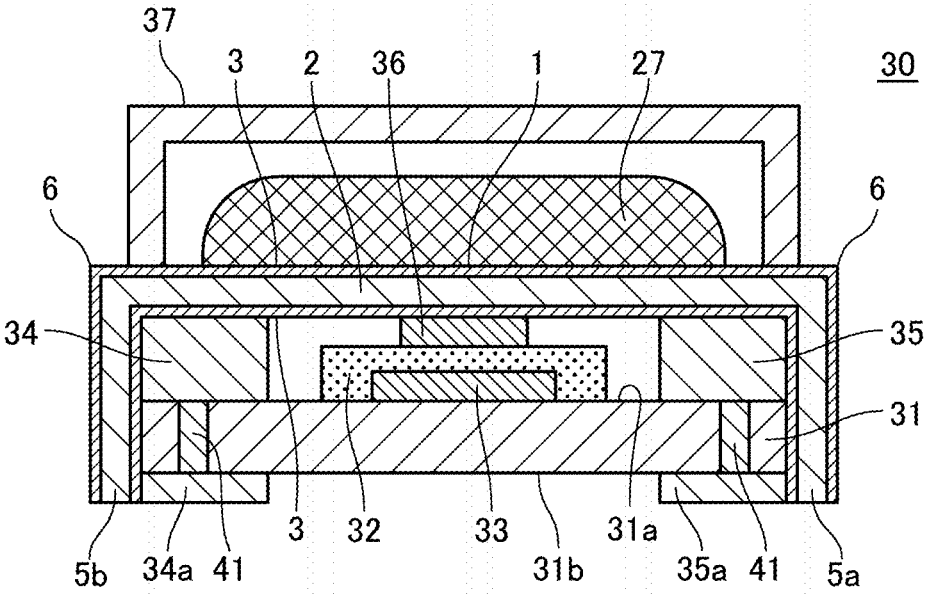
Figure 16:
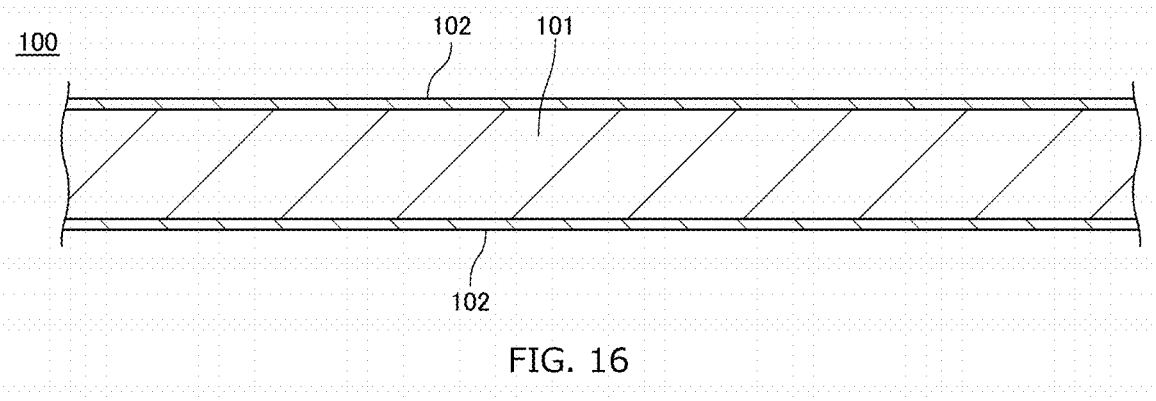
FIG. 16 is a cross-sectional view of a conventional fuse element.
Figure 17:
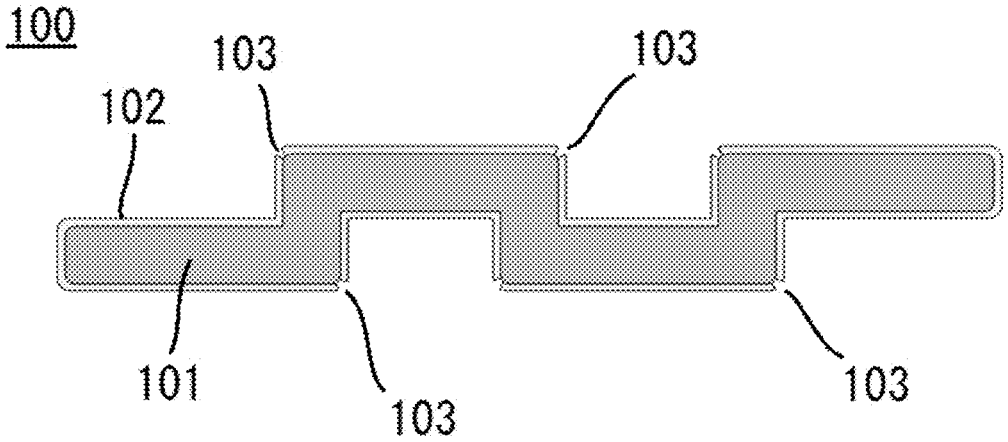
FIG. 17 is a cross-sectional view of a conventional fuse element with cracks occurring in bent portions.
Figure 18A:
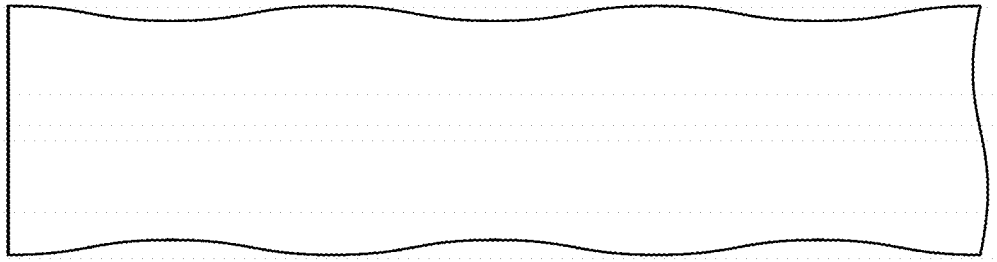
FIG. 18 is a view illustrating the images of FIG. 15 as line drawings.
Figure 18B:
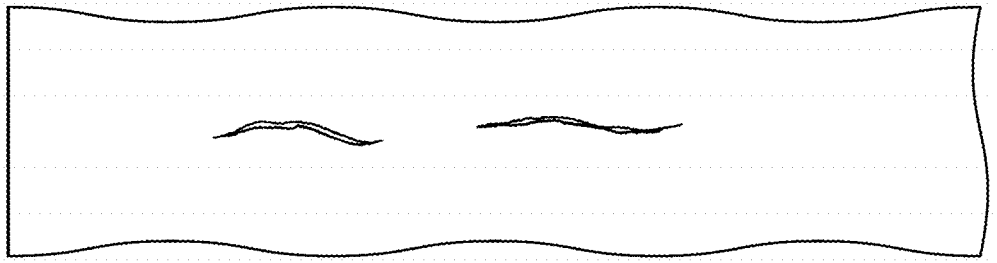
Figure 18C:
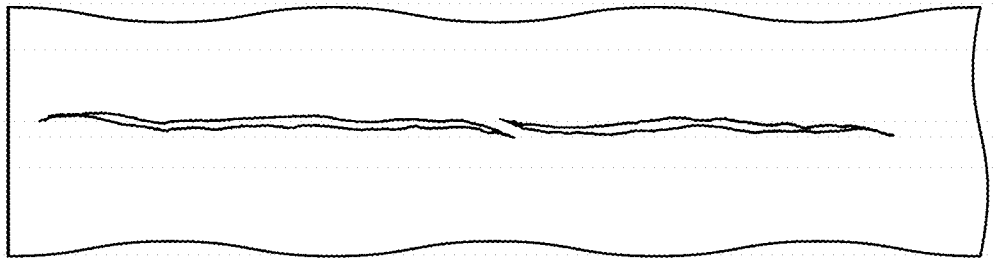

It should be noted that, in the protective device 30, instead of providing the terminal portions 5*a*, 5*b* in the fuse element 1, or, as illustrated in FIG. 13, in addition to providing the terminal portions 5*a*, 5*b*, a first and second external connection electrodes 34*a*, 35*a* electrically connected to the first and second electrodes 34, 35 may be provided on a bottom surface 31*b* of the insulating substrate 31. The first and second electrodes 34, 35 and the first and the second external connection electrodes 34*a*, 35*a* are conductively connected via through-holes 41 or castellations penetrating the insulating substrate 31. The first and second external connection electrodes 34*a*, 35*a* are also respectively formed by a conductive pattern such as of Ag or Cu and may also have a protective layer of Sn plating, Ni/Au plating, Ni/Pd plating, Ni/Pd/Au plating, or other plating formed as appropriate on their surfaces as a measure against oxidation. By connecting to external connection electrodes of the external circuit substrate on which the protective device 30 is mounted via the first and second external connection electrodes 34*a*, 35*a* instead of or together with the terminal portions 5*a*, 5*b*, the protective device 30 is incorporated in a current path formed in the external circuit substrate.

EXAMPLES

Hereinafter, examples according to the present disclosure will be described. In these examples, rectangular plate-shaped laminated bodies of laminated high melting point metal and low melting point metal were heat-treated at a predetermined temperature/time before forming fuse elements having bent portions formed by bending into a concave/convex pattern as illustrated in FIG. 14. Then, bent portions of the fuse elements of Examples and Comparative Examples were visually inspected for the presence of cracks.

The fuse elements used in Examples and Comparative Examples had a 200 μm-thick Sn—Ag—Cu-containing solder foil (Sn:Ag:Cu=96.5:3.0:0.5 wt %) as a low melting point metal constituting an inner layer on which a 13 μm-thick Ag plating was formed by electrolytic plating to laminate a high melting point metal layer.

Example 1

In Example 1, laminated bodies of low melting point metal and high melting point metal were heat-treated at 120° C. for 60 minutes before forming fuse elements having bent portions formed by bending into a concave/convex pattern at normal temperature. Visual inspection of the bent portions revealed reduced cracking in comparison with Comparative Example 1 described below.

Example 2

In Example 2, laminated bodies of low melting point metal and high melting point metal were heat-treated at 130° C. for 15 minutes before forming fuse elements having bent portions formed by bending into a concave/convex pattern at normal temperature. Visual inspection of the bent portions revealed reduced cracking in comparison with Comparative Example 1 described below.

Furthermore, measuring the fuse element of Example 2 as a sample with X-ray diffraction produced an X-ray diffraction spectrum which was analyzed for the full widths at half maximum of 2θ peaks for the {111} and {200} planes resulting in 0.135 degrees for the {111} planes and 0.060 degrees for the {200} planes; the ratio of peak intensities for the {111} and {200} planes (200 planes/111 planes) was 8.280.

Example 3

In Example 3, laminated bodies of low melting point metal and high melting point metal were heat-treated at 150° C. for 15 minutes before forming fuse elements having bent portions formed by bending into a concave/convex pattern at normal temperature. Visual inspection of the bent portions revealed that cracks were absent.

Furthermore, measuring the fuse element of Example 3 as a sample with X-ray diffraction produced an X-ray diffraction spectrum which was analyzed for the full widths at half maximum of 2θ peaks for the {111} and {200} planes resulting in 0.077 degrees for the {111} planes and 0.070 degrees for the {200} planes; the ratio of peak intensities of the {111} and {200} planes (200 planes/111 planes) was 7.833.

Example 4

In Example 4, laminated bodies of low melting point metal and high melting point metal were heat-treated at 150° C. for 60 minutes before forming fuse elements having bent portions formed by bending into a concave/convex pattern at normal temperature. Visual inspection of the bent portions revealed the absence of cracks.

Example 5

In Example 5, laminated bodies of low melting point metal and high melting point metal were heat-treated at 200° C. for 15 minutes before forming fuse elements having bent portions formed by bending into a concave/convex pattern at normal temperature. Visual inspection of the bent portions revealed the absence of cracks.

Furthermore, measuring the fuse element of Example 5 as a sample with X-ray diffraction produced an X-ray diffraction spectrum which was analyzed for the full widths at half maximum of 2θ peaks for the {111} and {200} planes resulting in 0.068 degrees for the {111} planes and 0.071 degrees for the {200} planes; the ratio of peak intensities of the {111} and {200} planes (200 planes/111 planes) was 5.073.

Example 6

In Example 6, laminated bodies of low melting point metal and high melting point metal were heat-treated at 200° C. for 60 minutes before forming fuse elements having bent portions formed by bending into a concave/convex pattern at normal temperature. Visual inspection of the bent portions revealed the absence of cracks.

Furthermore, measuring the fuse element of Example 6 as a sample with X-ray diffraction produced an X-ray diffraction spectrum which was analyzed for the full widths at half maximum of 2θ peaks for the {111} and {200} planes resulting in 0.065 degrees for the {111} planes and 0.070 degrees for the {200} planes; the ratio of peak intensities of the {111} and {200} planes (200 planes/111 planes) was 5.794.

Example 7

In Example 7, laminated bodies of low melting point metal and high melting point metal were heat-treated at 210°

C. for 15 minutes before forming fuse elements having bent portions formed by bending into a concave/convex pattern at normal temperature. Visual inspection of the bent portions revealed the absence of cracks.

Comparative Example 1

In Comparative Example 1, laminated bodies of low melting point metal and high melting point metal were not heat-treated before forming fuse elements having bent portions formed by bending into a concave/convex pattern at normal temperature. Visual inspection of the bent portions revealed the presence of cracks.

Furthermore, measuring the fuse element of Comparative Example 1 as a sample with X-ray diffraction produced an X-ray diffraction spectrum which was analyzed for the full widths at half maximum of 2θ peaks for the {111} and {200} planes resulting in 0.182 degrees for the {111} planes and 0.233 degrees for the {200} planes; the ratio of peak intensities of the {111} and {200} planes (200 planes/111 planes) was 0.047.

Comparative Example 2

In Comparative Example 2, laminated bodies of low melting point metal and high melting point metal were heat-treated at 100° C. for 60 minutes before forming fuse elements having bent portions formed by bending into a concave/convex pattern at normal temperature. Visual inspection of the bent portions revealed the presence of cracks.

Comparative Example 3

In Comparative Example 3, laminated bodies of low melting point metal and high melting point metal were heat-treated at 110° C. for 60 minutes before forming fuse elements having bent portions formed by bending into a concave/convex pattern at normal temperature. Visual inspection of the bent portions revealed the presence of cracks.

TABLE 1

| | Ex. 1 | Ex. 2 | Ex. 3 | Ex. 4 | Ex. 5 | Ex. 6 | Ex. 7 | Comp. 1 | Comp. 2 | Comp. 3 |
|---|---|---|---|---|---|---|---|---|---|---|
| Temp. | 120° C. | 130° C. | 150° C. | 150° C. | 200° C. | 200° C. | 210° C. | — | 100° C. | 110° C. |
| Duration | 60 min | 15 min | 15 min | 60 min | 15 min | 60 min | 15 min | — | 60 min | 60 min |
| Cracks | Reduced | Reduced | Absent | Absent | Absent | Absent | Absent | Present | Present | Present |

TABLE 2

| | | Comp. 1 | Ex. 2 | Ex. 3 | Ex. 5 | Ex. 6 |
|---|---|---|---|---|---|---|
| FWHM (degrees) | 111 planes | 0.182 | 0.135 | 0.077 | 0.068 | 0.065 |
| | 200 planes | 0.233 | 0.060 | 0.070 | 0.071 | 0.070 |
| Peak intensity ratio (200 planes/111 planes) | | 0.047 | 8.280 | 7.833 | 5.073 | 5.794 |

As represented in Table 1, in each of fuse elements of the Examples, the laminated bodies of high melting point metal and low melting point metal were heat-treated at 120° C. or more before forming bent portions so that crystallinity in the high melting point metal was improved and cracks were suppressed in bent portions of the fuse element.

In contrast, because bent portions of Comparative Example 1 were formed without heat treatment, cracks occurred. Moreover, because the heating temperatures in Comparative Examples 2 and 3 were lower than 120° C., crystallinity of the high melting point metal was low and cracks occurred.

FIG. 15 is an enlarged image of bent portions of fuse elements of Examples and Comparative Examples. As shown in FIG. 15 (A), cracks were not observed in bent portions in Examples 3 to 7. As shown in FIG. 15 (B), almost no cracking was observed in bent portions in Examples 1 and 2. However, as shown in FIG. 15 (C) cracks were observed in Comparative Examples 1 to 3.

As represented in Table 2, X-ray diffraction spectra of fuse elements of Examples 2, 3, 5, and 6 were used to analyze the full widths at half maximum of 2θ peaks for the {111} and {200} planes resulting in 0.15 degrees or less for the {111} and {200} planes while results were 0.18 degrees or greater for the full widths at half maximum for the {111} and {200} planes in Comparative Example 1. This revealed that, among peaks of the X-ray diffraction spectrum (2θ) of the surface of a high melting point metal layer, by at least one of the peaks having a full width at half maximum of 0.15 or less, good crystallinity could be achieved and cracks could be suppressed.

In contrast with the fuse element of Comparative Example 1 having a ratio of peak intensities (200 planes/111 planes=0.047) for the {111} and {200} planes, the fuse element of Examples 2, 3, 5, and 6 had a ratio of peak intensities (200 planes/111 planes) with an inverse relation for the {111} and {200} planes; this indicates that crystal orientation was changed by heat-treating at a temperature of 120° C. or higher and it was found that this improved crystallinity and contributed to crack suppression.

Moreover, improving crystallinity of the fuse elements of the Examples suppresses resistance increases otherwise caused by grain boundaries and lattice defects, which improves current ratings and can maintain desired blowout properties of achieving rapid blowout at a predetermined current value while avoiding blowout at or below the predetermined current value.

REFERENCE SIGNS LIST

1 fuse element, 2 low melting point metal layer, 3 high melting point metal layer, 5 terminal portion, 6 bent portion, 7 open hole, 8 blind hole, 9 concave/convex portion, 20 fuse device, 21 insulating substrate, 22 cover member, 23 groove, 24 first electrode, 24*a* first external connection electrode, 25 second electrode, 25*a* second external connection electrode, 27 flux, 28 device housing, 30 protective device, 31 insulating substrate, 32 electrically insulating member, 33 heat generator, 34 first electrode, 34*a* first external connection electrode, 35 second electrode, 35*a* second external connection electrode, 36 heat generator lead electrode, 37 cover member, 38 first heat generator electrode, 39 second heat generator electrode, 41 through-hole

The invention claimed is:

1. A fuse element having a low melting point metal layer and a high melting point metal layer which are laminated, wherein at least one peak among peaks in an X-ray diffraction spectrum (2θ) of a surface of the high melting point metal layer has a full width at half maximum of 0.15 degrees or less.

2. The fuse element according to claim 1, wherein the fuse element has a bent portion in at least one location.

3. The fuse element according to claim 1, wherein the low melting point metal layer is an inner layer, and the high melting point metal layer is laminated above and below the inner layer.

4. The fuse element according to claim 1, wherein the low melting point metal comprises Sn or an alloy containing Sn as a primary constituent, and the high melting point metal comprises Ag, Cu, or an alloy containing Ag or Cu as a primary constituent.

5. A method for manufacturing a fuse element comprising:

a laminating step of laminating a high melting point metal layer and a low melting point metal layer; and a heating step of heating the high melting point metal layer to a temperature of at least 120° C. and at most a melting point of the low melting point metal layer.

6. The method for manufacturing a fuse element according to claim 5, further comprising forming a bent portion in at least one location after the heating step.

7. The method for manufacturing a fuse element according to claim 5, wherein the low melting point metal layer comprises Sn or an alloy having Sn as a primary constituent, the high melting point metal layer comprises Ag, Cu, or an alloy containing Ag or Cu as a primary constituent, and the heating step includes heating to a temperature of at most 210° C.

8. A fuse device comprising:

an insulating substrate; and the fuse element of claim 1 mounted on the insulating substrate.

9. A protective device comprising:

an insulating substrate;

the fuse element of claim 1 mounted on the insulating substrate; and a heat generator arranged on the insulating substrate for heating and blowing the fuse element.

* * * * *